US006200207B1

(12) United States Patent
Hsu

(10) Patent No.: US 6,200,207 B1
(45) Date of Patent: Mar. 13, 2001

(54) DRESSING APPARATUS FOR CHEMICAL MECHANICAL POLISHING PAD

(75) Inventor: Wei-Chieh Hsu, Hsinchu (TW)

(73) Assignee: Vanguard International Semiconductor Corp., Hsinchu (TW)

( * ) Notice: Subject to any disclaimer, the term of this patent is extended or adjusted under 35 U.S.C. 154(b) by 0 days.

(21) Appl. No.: 09/431,726

(22) Filed: Nov. 1, 1999

(30) Foreign Application Priority Data

Mar. 23, 1999 (TW) ..... 88204407

(51) Int. Cl.[7] ..... B24B 21/18

(52) U.S. Cl. ..... 451/443; 451/56; 451/287; 451/288; 451/443; 451/444

(58) Field of Search ..... 451/56, 287, 288, 451/443, 444

(56) References Cited

U.S. PATENT DOCUMENTS 5,885,137 * 3/1999 Ploessl ..... 451/56
6,004,193 * 12/1999 Nagahara et al. ..... 451/285
6,036,583 * 3/2000 Perlov et al. ..... 451/56
6,123,607 * 9/2000 Ravkin et al. ..... 451/56

* cited by examiner

*Primary Examiner*—Stephen F. Gerrity
*Assistant Examiner*—Shantese McDonald
(74) *Attorney, Agent, or Firm*—Darby & Darby

(57) ABSTRACT

The present invention relates to a dressing apparatus for conditioning and regenerating a chemical mechanical polishing (CMP) pad. More specifically, the invention relates to a diamond disc dresser that employs an air spraying assembly and radially arranged dressing tools to clean, flatten, and roughen the polishing pad. Each of the dressing tools points at a same radial angle but are not necessarily equidistantly separated. Furthermore, a debris collector is used to collect the micro-particles and other types of contamination after they are swept off the working surface of the polishing pad.

13 Claims, 4 Drawing Sheets

DRESSING APPARATUS FOR CHEMICAL MECHANICAL POLISHING PAD

BACKGROUND OF THE INVENTION

1. Field of the Invention

The present invention relates to a dressing apparatus for conditioning and regenerating a chemical mechanical polishing (referred to as CMP hereafter) pad; more specifically, the invention relates to a diamond disc dresser that cleans, flattens, and roughens the polishing pad.

2. Description of Related Art

A CMP device for polishing the surface of a semiconductor wafer includes a carrier for holding the semiconductor wafer and a polishing pad made of porous material polishes the wafer while retaining polishing slurry. The polishing slurry is a polishing fluid of certain grainy property. The carrier and pad are positioned such that the surface of the semiconductor wafer to be polished faces upward. The slurry is fed to the rear of the pad such that the porosity of the polishing pad allows the slurry to penetrate from the rear to the front of the pad.

Conventionally, two types of diamond disc dressers for conditioning the CMP pad are utilized by industry: annular disc type and spiky disc type.

An annular disc type dresser is a ring-shaped dressing apparatus with embedded synthetic diamond tool bits on its working surface. The main functions of the annular disc type dresser are to clean, roughen, and flatten the polishing pad of a CMP device. Nevertheless, it is extremely difficult to control the quality of the annular disc type dresser when it is being manufactured since the tiny diamond tool bits have to be permanently grafted to the working surface of the dresser with extreme evenness and tightness.

A spiky disc type dresser, on the other hand, is a disc dresser with a plurality of replaceable cylindrical spikes, wherein synthetic diamond bits are embedded on the tip portion of the cylindrical spikes. Since only a small area of the spiky type dresser is embedded with synthetic diamond bits, it is much simpler to manufacture the spiky disc type dresser compared with that of the annular disc type dresser. However, the spiky disc type dresser is less effective in cleaning, flattening, and roughening the pad.

SUMMARY OF THE INVENTION

Accordingly, it is an object of the present invention to improve on a dressing apparatus for the conditioning and regeneration of a CMP pad which is simple to manufacture and provides effective cleaning, flattening, and roughening of the CMP pad.

The present invention meets this object by providing a dressing apparatus comprising: a rotatable inner shaft defining a first axis; an outer sleeve shaft disposed around the inner shaft; an air cap comprising a bottomless air chamber and at least one opening penetrating its upper surface for receiving compressed air; an air cap support connected to the outer sleeve shaft and supporting the curved air cap; a carrier plate disposed beneath the air cap and having an upper surface, a lower surface, and a plurality of through holes communicating the upper surface and the lower surface, wherein the upper surface is coupled to the inner shaft so as to rotate the carrier plate about the first axis, and the through holes receive compressed air from the air cap when the rotation of the carrier plate brings them under the air cap; and a plurality of dressing tools, each having a mounting surface and a dressing surface, wherein the mounting surfaces of the dressing tools are mounted to the lower surface of the carrier plate with the dressing surfaces facing the working surface of the CMP pad; wherein, the rotation of carrier plate conditions and regenerates the working surface of the CMP pad by action of the dressing surfaces of the dressing tools, and compressed air provided through the air cap is forced through the plurality of through holes in the carrier plate, thereby forcing micro-particles and other types of contamination off the working surface of the CMP pad.

The air cap can be curved, wherein the center of the curvature of the air cap is the first axis, and the air cap spans a spanning angle no greater than 180° and preferably no greater than 120°. A plurality of tiny synthetic diamond bits can permanently grafted onto the dressing surfaces of the dressing tools to enhance the conditioning and regenerating action. A debris collector can be provided for collecting the micro-particles and other types of contamination swept of the working surface of the CMP pad.

BRIEF DESCRIPTION OF THE DRAWINGS

Other objects, features, and advantages of the present invention will become apparent from the following detailed description of the preferred but non-limiting embodiment. The description is made with reference to the accompanying drawings in which.

DETAILED DESCRIPTION OF THE PREFERRED EMBODIMENT

Figure 1A:
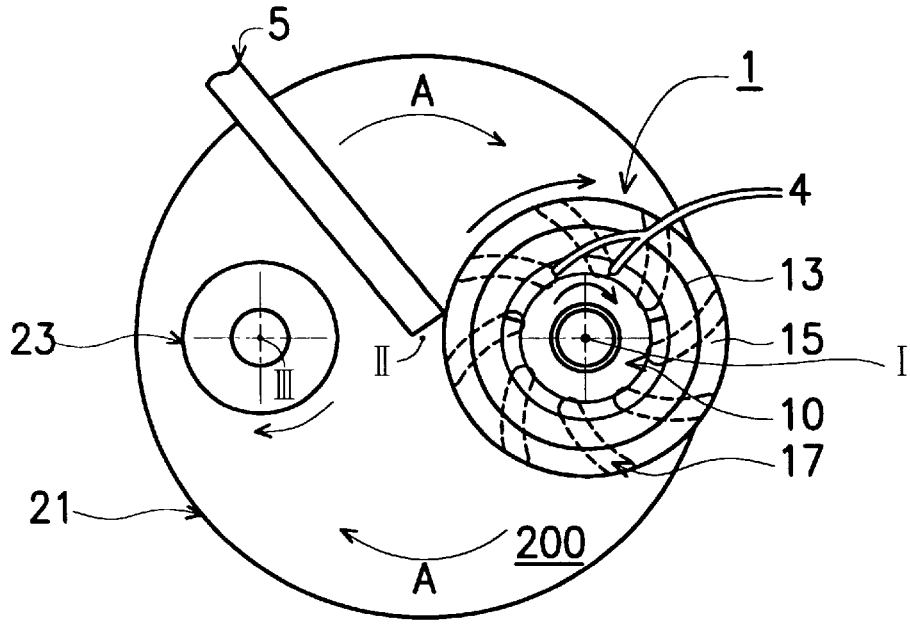
FIG. 1A is a top view of a the dressing apparatus of this invention positioned on top of a CMP machine.
Figure 1B:
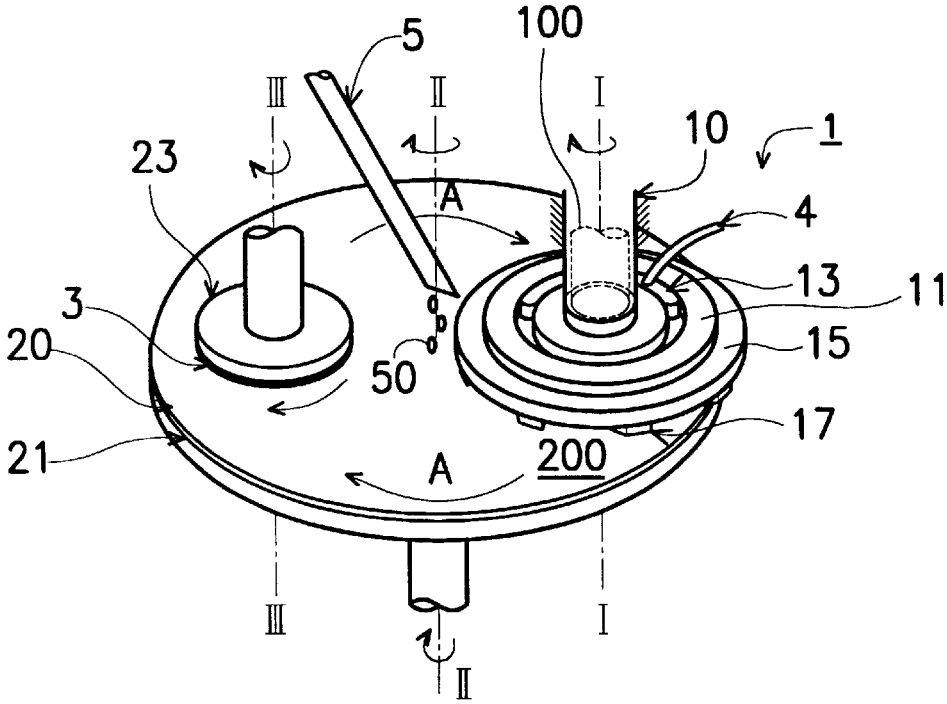
FIG. 1B is a perspective view of the drawing shown in FIG. 1A.

FIG. 1A shows a top view of a dressing apparatus 1 of the preferred embodiment of the present invention, illustrating how it is integrated into a CMP device for wafer processes. FIG. 1B is a perspective view of FIG. 1A.

As shown in FIGS. 1A and 1B, the dressing apparatus 1 includes a sleeve bearing mechanism, wherein a rotatable inner shaft 100 supports the weight of the carrier plate 15 and the dressing tools 17, while a non-rotating outer sleeve shaft 10 supports the weight of the air spraying assembly, which includes an air cap support 11 and an air cap 13. Viewed from the top, the inner shaft 100 rotates in a clockwise direction with the first axis I—I as its rotating axis, whereby the carrier plate 15 and its dressing tools 17 carried thereunder are also driven to rotate. A manipulator (not shown) is adopted for moving of the dressing apparatus 1 to a specified location on the polishing pad 20. Furthermore, the polishing pad 20 comprises a layer of microporous polyurethane material having an upward working surface 200 and operating on top of a rotating platform 21, wherein the upward working surface 200 and rotating platform 21 are concentric and rotate clockwise about a second axis II—II. A wafer carrier 23, rotates about a third axis III—III, a wafer 3 being carried on its underside (for example, by suction or vacuum actuated mechanism) to be polished by the working surface 200 of the polishing pad 20 and a polishing slurry 50. The dressing apparatus 1 is positioned on top of the polishing pad 20 and aside from the second axis II—II, and the polishing slurry is delivered onto the working surface 200 via a nozzle slurry distribution system 5, whereby the porous polishing pad 20 is permeated with the polishing slurry 50.

Figure 2A:
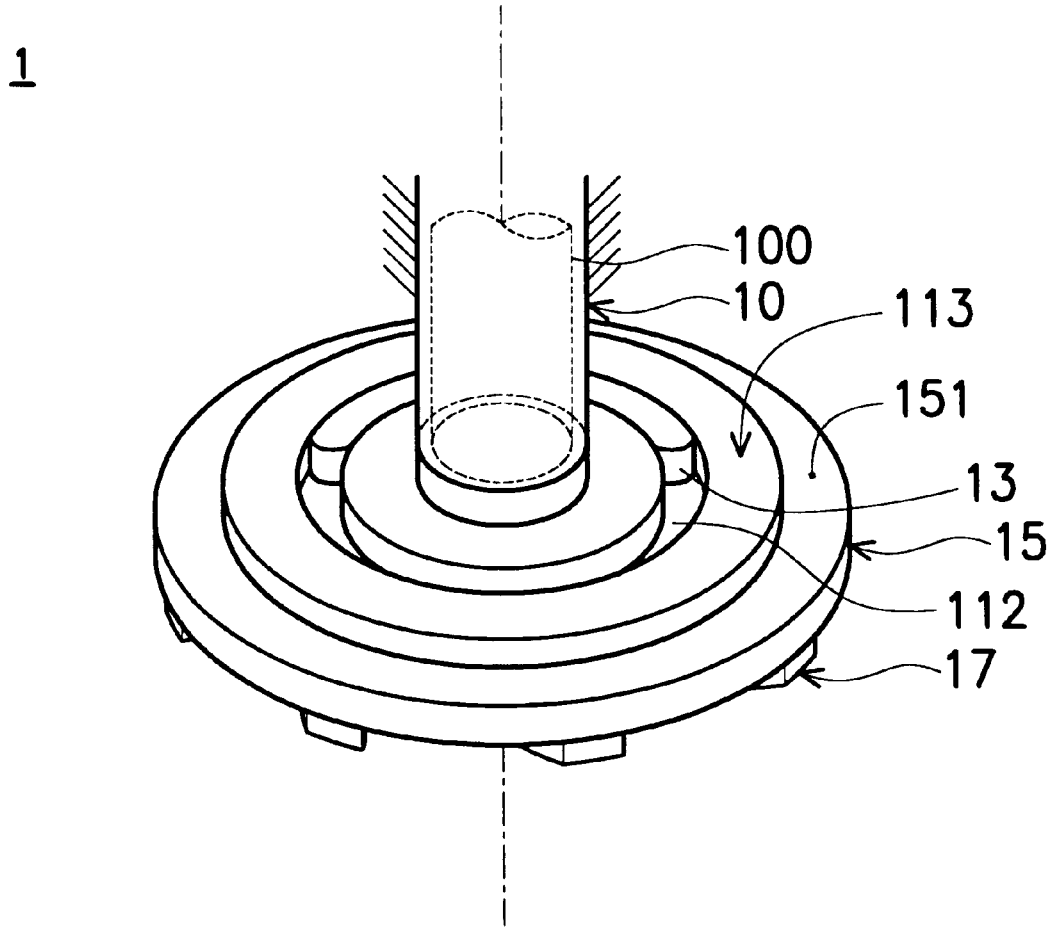
FIG. 2A is a detailed perspective drawing of the dressing apparatus of the present invention.
Figure 2B:
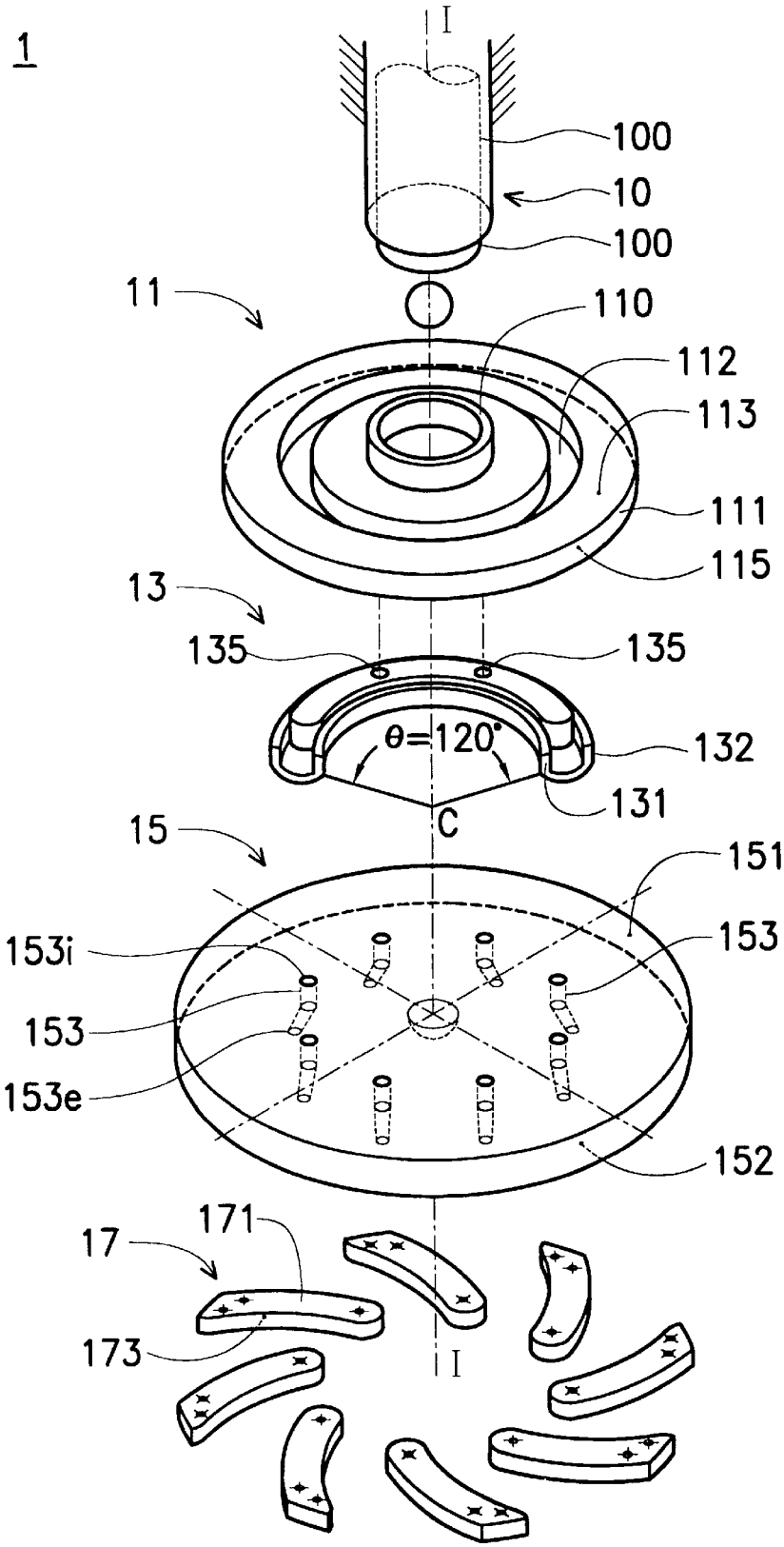
FIG. 2B shows an exploded view of the dressing apparatus of the present invention.
Figure 3:
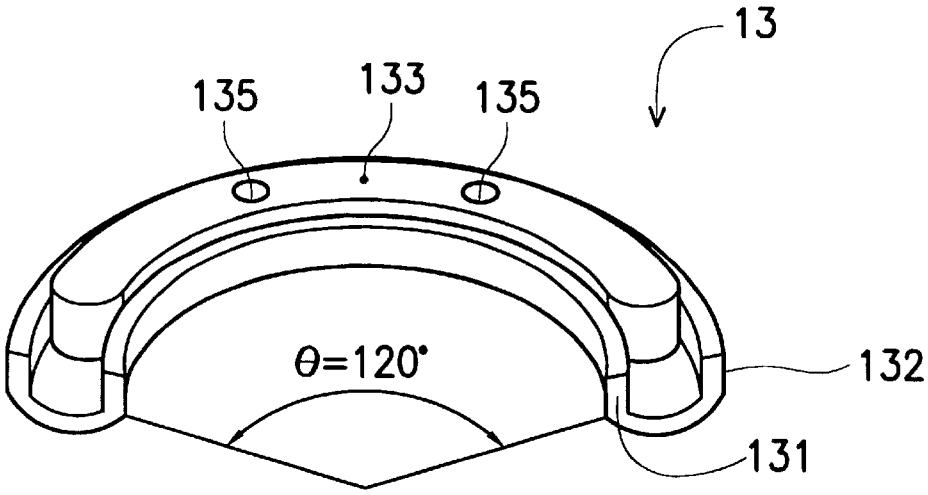
FIG. 3 is a perspective view of a curved air cap component for trapping compressed air according to the present invention.

Please refer to FIGS. 2A, 2B, and 3. FIG. 2A depicts the perspective view of the dressing apparatus 1 as a unit, FIG. 2B shows an exploded view of the dressing apparatus 1 in perspective view, and FIG. 3 is a perspective view of a curved air cap 13 which traps compressed air.

As shown in FIG. 2B, the dressing apparatus 1, according to a preferred embodiment of the present invention, comprises an air cap support 11, a curved air cap 13, a carrier plate 15, and a plurality of dressing tools 17.

The air cap support 11 is a saucer-like supporting structure with a center hole portion 110 and an outer rim member 111 separated by an annular slot opening 112 that is configured for the insertion of the curved air cap 13. The annular slot opening 112 communicates the top and bottom surfaces 113 and 115 of the air cap support 11, and the center hole portion 110 is centered at point C, wherein C is on the first axis I—I. The air cap support 11 is coupled to the sleeve shaft 10 by fitting its center hole portion 110 to the outside circumference of the sleeve shaft 10. Note that the inner shaft 100 rotates while the outer sleeve 10 and components coupled thereto (the air cap support 11 and the air cap 13) remain stationary.

The curved air cap 13, comprises a curved bottomless air chamber 130 having its curvature centered at point C, and at least one opening 135 communicating the chamber 130 to the outer surface 133 of the curved air cap 13 (two openings 135 are illustrated). The curved air cap 13 can be provided with sidewalls 131 and 132 extending parallel to the sides of the curved air chamber 130 to be received in concentric annular recesses formed in the bottom surfaces of the center hole portion 110 and the outer rim portion 111. Please refer to FIG. 3. The curved air cap 13, centered at point C, spans an angle of $\theta=120°$ according to a preferred embodiment of the present invention. However, it can also span any angle up to $\theta=180°$. The curved air cap 13 is assembled to the air cap support 11 by inserting the air chamber 130 of the curved air cap 13 into and through the annular slot opening 112 of the air cap support 11 from underneath. When the two parts are thus mated, as shown in FIG. 2A, the air cap 13 fits tightly in the annular slot opening 112, with the multiplicity of openings 135 of the air chamber 130 on top.

The carrier plate 15 is a circular plate having a upper surface 151 and a lower surface 152, wherein the upper surface 151 of the carrier plate 15 is coupled to the inner shaft 100 with the first axis I—I being their common center axis. The inner shaft 100 drives the carrier plate 15 to rotate immediately beneath the curved air cap 13. A plurality of dressing tools 17 are mounted on the lower surface 152 facing towards the working surface 200 of the polishing pad 20. In addition, a multiplicity of through holes 153 symmetrical to the first axis I—I are arranged and positioned on the carrier plate 15 in such fashion that the inlet openings 153*i* are located on the upper surface 151 while the outlet openings 153*e* are to be located on lower surface 152. Each of the through holes 153 is an air passageway having a deflected angle halfway between the air inlet opening 153*i* and the outlet opening 153*e;* the deflected angle in each of the through holes 153 is designed with the intention to force the pressurized air out at a direction away from the axis of the dressing apparatus 1 so that debris, or micro-particles generated by the CMP process, can by pushed off the working surface 200 of the polishing pad 20.

Figure 4A:
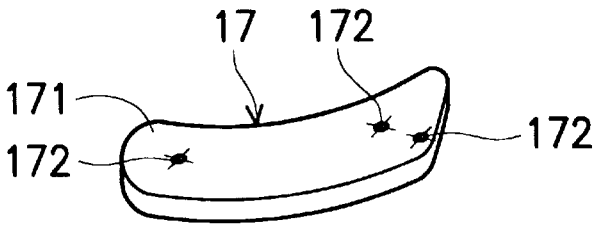
FIG. 4A is a perspective drawing of one of the dressing tools shown in FIGS. 2A and 2B.
Figure 4B:
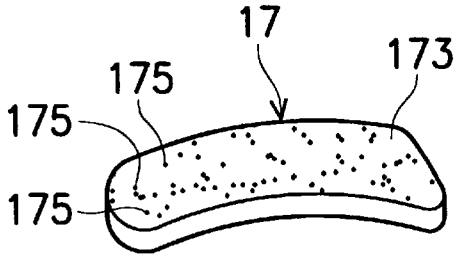
FIG. 4B is a perspective drawing depicting the dressing tool of FIG. 4A from an opposing angle.

As shown by FIG. 2B, a plurality of dressing tools 17, each with curved surface outlines, are radially installed onto the lower surface 152 of the carrier plate 15 with the first axis I—I as their common center point. Also referring to FIGS. 4A and 4B, each of the dressing tools 17 has a mounting surface 171 and a dressing surface 173, wherein the mounting surface 171 is for mounting the dressing tool 17 onto the lower surface 152 of the carrier plate 15 and the dressing surface 173 for conditioning and regeneration of the working surface 200 of the polishing pad 20. Furthermore, a plurality of tiny synthetic diamond bits 175 are permanently grafted onto the dressing surface 173 of the dressing tool 17, which provides the needed dressing effect.

Referring back to FIG. 1A, each of the dressing tools 17 located on the lower surface 152 of the carrier plate 15 is pointing in the same radial angle. In this embodiment, they are equidistant.

Referring to FIG. 2A, a detailed perspective drawing of the dressing apparatus with air cap support 11, carrier plate 15, a plurality of dressing tools 17, inner shaft 100, outer sleeve 10, and curved air cap 13 assembled together as a whole. Referring again to FIG. 1A, in operation, compressed nitrogen ($N_2$) from a compressed nitrogen source 4 would enter the air chamber 130 by the multiplicity of openings 135 on top of the air cap 13. When part of the rotating carrier plate 15 with the through holes 153 is directly under and exposed to the bottomless air chamber 130, the compressed air inside the air chamber 130 will be forced out via the through holes 153 of the carrier plate 15 and exit said outlet opening 153*e* at a deflected angle.

Referring to FIGS. 1A and 1B again, the working surface 200 of the polishing pad 20 rotates in clockwise direction A as shown. While the dressing apparatus 1, rotating swiftly in clockwise direction as well, brushes over the working surface 200 of the polishing pad 20, the synthetic diamond bits 175 roughen the working surface 200 and remove the adhered micro-particle debris. The polishing pad 20 is reconditioned and regenerated to provide a smoother and more consistent polishing finish for wafers 3 since the working surface 200 of the polishing pad 20 is constantly being cleaned, roughened, and flattened by means of the diamond bits 175 and said air spraying assembly. A debris collector (not shown) can be provided to collect the micro-particles and other types of contamination after they are swept off the working surface 200 of the polishing pad 20.

Therefore, the CMP dressing apparatus according to the preferred embodiments of the present invention can effectively cleans, roughens, and flattens the polishing pad 20, which in turn improves the yield and reliability of wafer-making process.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A chemical mechanical polishing (CMP) dressing apparatus for conditioning and regenerating the working surface of a CMP polishing pad, comprising:

a rotatable inner shaft defining a first axis;

a non-rotating outer sleeve shaft disposed around the inner shaft;

an air cap comprising a bottomless air chamber with at least one opening for receiving compressed air;

an air cap support connected to the outer sleeve shaft and supporting the air cap;

a carrier plate disposed beneath the air cap and having an upper surface, a lower surface, and a plurality of through holes communicating the upper surface and the lower surface, wherein the upper surface is coupled to the inner shaft so as to rotate the carrier plate about the first axis, and the through holes receive compressed air from the air cap when the rotation of the carrier plate brings them under the air cap; and a plurality of dressing tools, each having a mounting surface and a dressing surface, wherein the mounting surfaces of the dressing tools are mounted to the lower surface of the carrier plate with the dressing surfaces facing the working surface of the CMP pad;

wherein, the rotation of carrier plate conditions and regenerates the working surface of the CMP pad by action of the dressing surfaces of the dressing tools, and compressed air provided through the air cap is forced through the plurality of through holes in the carrier plate to the working surface of the CMP pad, thereby sweeping off micro-particles and other types of contamination.

2. The CMP dressing apparatus as claimed in claim 1, wherein the air cap is curved, and the air cap support has an annular slot for receiving the air cap.

3. The CMP dressing apparatus as claimed in claim 2, wherein the center of the curvature of the air cap is the first axis, and the air cap spans an spanning angle no greater than 180°.

4. The CMP dressing apparatus as claimed in claim 3, wherein the air cap spans an angle no greater than 120°.

5. The CMP dressing apparatus as claimed in claim 1, wherein the through holes are arranged in a circular fashion about the first axis corresponding to the air cap.

6. The CMP dressing apparatus as claimed in claim 1, wherein the through holes are formed with a deflected angle pointing away from the first axis.

7. The CMP dressing apparatus as claimed in claim 1, wherein the dressing tools are curved.

8. The CMP dressing apparatus as claimed in claim 1, wherein a plurality of tiny synthetic diamond bits are permanently grafted onto the dressing surfaces of the dressing tools.

9. The CMP dressing apparatus as claimed in claim 1, wherein the mounting surfaces of the dressing tools are mounted to the lower surface of the carrier plate radially with the first axis as a common center point.

10. The CMP dressing apparatus as claimed in claim 9, wherein the dressing tools share the same radial angle.

11. The CMP dressing apparatus as claimed in claim 10, wherein the dressing tools are spaced equidistantly apart.

12. The CMP dressing apparatus as claimed in claim 10, wherein the dressing tools are not spaced equidistantly apart.

13. The CMP dressing apparatus as claimed in claim 1, wherein a debris collector is provided for collecting the micro-particles and other types of contamination swept of the working surface of the CMP pad.

* * * * *